United States Patent [19]

Kopf

[11] 3,986,797

[45] Oct. 19, 1976

[54] MAGNETIC PUMP

[75] Inventor: J. David Kopf, Tujunga, Calif.

[73] Assignee: David Kopf Systems, Tujunga, Calif.

[22] Filed: Oct. 20, 1975

[21] Appl. No.: 624,307

Related U.S. Application Data

[63] Continuation of Ser. No. 471,458, May 20, 1974, abandoned.

[52] U.S. Cl. ..... 417/420

[51] Int. Cl.[2] ..... F04B 17/00

[58] Field of Search ..... 417/420, 366, 369; 418/102, 86

[56] References Cited

UNITED STATES PATENTS

| | | | |
|---|---|---|---|
| 2,460,371 | 2/1949 | Szwargulski | 417/369 |
| 3,205,827 | 9/1965 | Zimmermann | 417/420 |
| 3,238,878 | 3/1966 | Martin | 417/420 |
| 3,238,883 | 3/1966 | Martin | 417/420 |
| 3,420,184 | 1/1969 | Engelsberg | 417/420 |
| 3,470,824 | 10/1969 | O'Connor | 417/420 |
| 3,500,755 | 3/1970 | Gibson | 417/366 |
| 3,647,314 | 3/1972 | Laessing | 417/420 |
| 3,736,075 | 5/1973 | Otto | 417/420 |
| 3,802,804 | 4/1974 | Zimmermann | 417/420 |

FOREIGN PATENTS OR APPLICATIONS

| | | | |
|---|---|---|---|
| 170,755 | 9/1951 | Austria | 417/420 |

*Primary Examiner*—Henry F. Raduazo
*Attorney, Agent, or Firm*—Bruce H. Johnsonbaugh

[57] ABSTRACT

A pump is provided in which the fluid being pumped is used to lubricate the moving parts of the pump and the flow path of the fluid through the pump insures that at least a portion of the fluid circulates around the moving parts of the pump to assure efficient lubrication and rapid flushing of the pump. The pump is driven by a pair of concentric magnets, the interior magnet being sealed off relative to the outer magnet.

1 Claim, 3 Drawing Figures

MAGNETIC PUMP

This is a continuation of application Ser. No. 471,458 filed May 20, 1974, now abandoned.

This invention pertains generally to pumps and more specifically to a pump usable in artificial kidney machines.

The pump of this invention is particularly useful for use in medical equipment which must frequently be sterilized. The pump of this invention facilitates the rapid and thorough flushing and sterilization of all its moving parts, thereby reducing the chance of undesirable contamination from bacterial growth in stagnant fluid within the pump.

A primary object of the invention is to provide a pump which may be rapidly flushed and sterilized.

A further object of this invention is to provide a pump for use in medical equipment in which the working fluid is not allowed to stagnate.

A further object of this invention is to provide a magnetically driven pump in which the driven magnet is positively sealed against the pump housing in order to prevent contamination of the working fluid through the power source for the pump. Further objects and advantages of the invention will become apparent from the following description of a preferred embodiment and the drawings in which.

Figure 1:
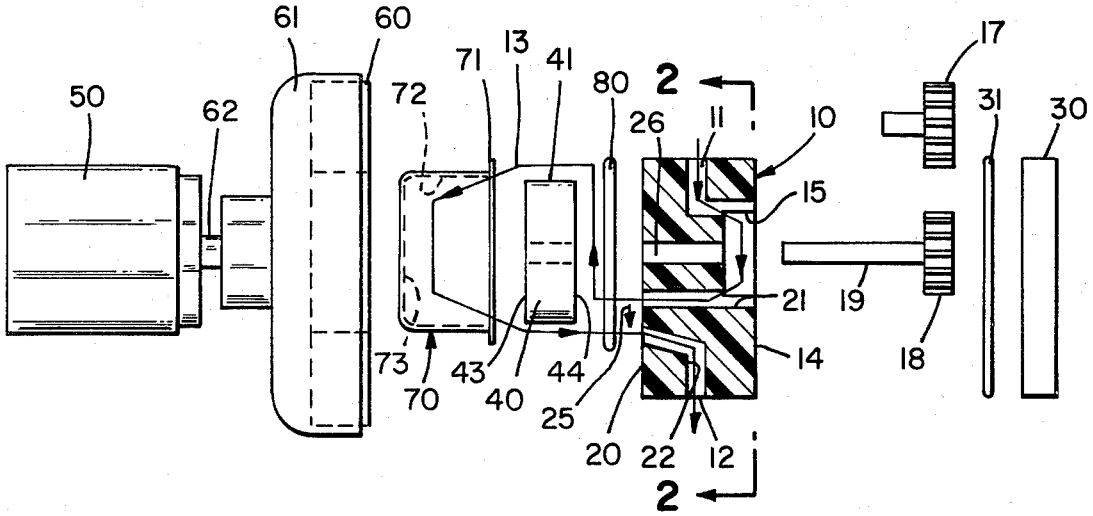
FIG. 1 is a side elevational exploded view of the components of the invention.

As shown in FIG. 1, pump housing 10 has an inlet port 11 and an outlet port 12. Working fluid flows along the path indicated by the line 13. When the pump is used in an artificial kidney machine, the working fluid is dialysate.

Figure 2:
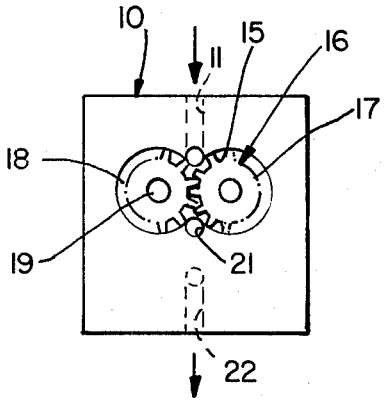
FIG. 2 is a front elevational view along the line 2—2 of FIG. 1.
Figure 3:
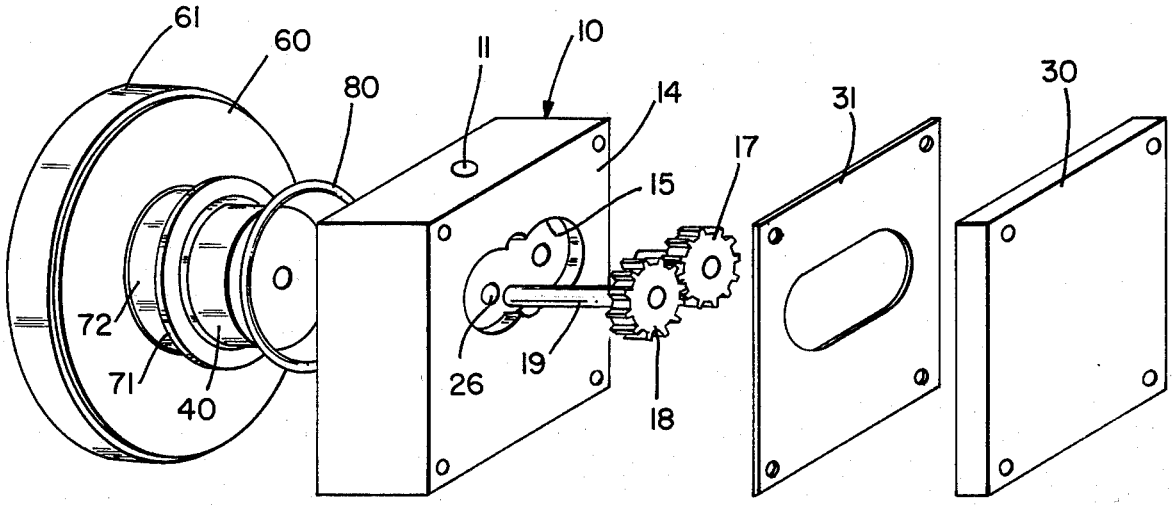
FIG. 3 is a perspective exploded view of the components of the invention.

Pumping cavity 15 in housing 10 is generally a figure-eight shaped cavity as shown in FIG. 2.

Impeller means 16 comprises idler gear 17 and driving gear 18. Driving gear 18 is connected to pump drive shaft 19. Pump drive shaft 19 extends from pumping cavity 15 through housing 10 and is carried by driven magnet 40.

A motor 50 rotates driving magnet 60 carried in case 61 which is connected to the output shaft 62 of motor 50. Driving magnet 60 and driven magnet 40 are each ceramic, permanent magnets. The rotation of driving magnet 60 by motor 50 induces the rotation of driven magnet 40 which in turn operates the pump.

Cover means 70 surrounds driven magnet 40. Flange 71 of cover means 70 is sealed against face 20 of housing 10 by means of O ring 80.

The moving parts of the pump are effectively sealed off with respect to driving magnet 60 and motor 50.

In order to facilitate rapid and thorough flushing of the pump, a first passageway 21 is provided in housing 10, extending from pump cavity 15 to the interior of cover means 70. A second passageway 22 is provided in housing 10 and extends from the interior of cover means 70 to outlet port 12. Fluid flowing through inlet port 11 and into pump cavity 15 is thereby pumped through first passageway 21 into the interior of cover means 70, where it circulates around driven magnet 40. The fluid flows from the interior of cover means 70 through second passageway 22 and through outlet port 12.

It is not necessary that all fluid flowing through pump cavity 15 circulate around driven magnet 40. A portion of the fluid flows directly from first passageway 21 into second passageway 22 as shown by arrow 25. The amount of fluid passing directly from first passageway 21 into second passageway 22 is dependent upon the relative clearances of driven magnet 40 from face 20 of housing 10 in relation to the clearance between face 41 of driven magnet 40 and the wall 72 of cover means 70.

The pump of this invention is fully lubricated by the fluid passing through the pump. The fluid lubricates drive shaft 19 by flowing between drive shaft 19 and the surface of passageway 26 in housing 10. The fluid also lubricates the surfaces of gear 17 and 18 and the surfaces of driven magnet 40.

Cover 30 and gasket 31 are mounted against face 14 of housing 10 to close pump cavity 15.

As used in an artificial kidney machine, it is frequently necessary to sterilize all components of the machine. It is important to sterilize all components, including the dialysate pump, in the least possible time. The supply of dialysate to inlet port 11 is shut off and sterilizing solution is introduced. The sterilizing solution is pumped through first passageway 21 into the interior of cover means 70, circulating around driven magnet 40 and thoroughly and efficiently sterilizing all areas of the pump into which dialysate has flowed during hemodialysis. When the sterilization cycle is completed, it is necessary to rinse the sterilizing solution out of the components of the machine. The rinsing solution follows the same flowpath and quickly and efficiently dilutes and washes the sterilizing solution out of all regions of the pump. After the rinse cycle, dialysate may be introduced through the pump, which again thoroughly and efficiently washes the rinsing solution from all parts of the pump.

In the preferred embodiment, gears 17 and 18 rotate between 1500–3000 rpm. Flowrate of dialysate through the pump is 250–500 ml/min. The diameter of gears 17 and 18 is approximately 9/16 inch. Face clearance of gears 17 and 18 is 0.002 inch, radial clearance is 0.001–0.003 inch. The diameter of driven magnet 40 is 1 inch, the radial clearance between magnet 40 and wall 72 of cover means 70 is 0.030 inch, the clearance between face 44 and face 20 of housing 10 is 0.060–0.090 inch and the clearance between face 43 of magnet 40 and wall 73 of cover means 70 is ⅛ – ¼ inch. Passageways 21 and 22 are 3/16 inch in diameter. With the parameters stated in this paragraph, the pump thoroughly flushes itself of sterilant in less than two minutes at a flowrate of 500 ml/min. The fluid passing through passageway 21 impinges against face 44 of driven magnet 40 and is flung outward radially by centrifugal force. Since the cross-sectional area between driven magnet 40 and wall 72 of cover means 70 [which is the circumference of driven magnet 40 ($\pi \times 1$ inch) multiplied by the clearance (0.030 inch) = 0.0942 sq. in] is roughly four times as great as the cross sectional area of passageway 22 ($\pi r^2 = 0.026$ sq. in), roughly 80% of the dialysate circulates around and behind driven magnet 40 and roughly 20% of the dialysate passes along the flowpath 25 into passageway 22.

I claim:

1. A magnetically driven gear pump for use in an artificial kidney machine comprising:

an idler gear and a drive gear in a figure-eight shaped pumping cavity formed in a housing;

a driving magnet connected to motor means;

a driven magnet in magnetically driven relationship with said driving magnet, sealed off with respect to said driving magnet, and connected to said drive gear by a drive shaft;

cover means surrounding said driven magnet and sealing against said housing, and said cover sealing said driving magnet from said driven magnet;

a first outlet passageway formed in said housing and extending from said pumping cavity to the interior of said cover means for carrying the high pressure fluid discharged from said pumping cavity to the interior of said cover means;

a second outlet passageway formed in said housing through which the fluid passes after flowing through the interior of said cover means; and the cross-sectional area of said second outlet passageway being less than the cross-sectional area between said driven magnet and said cover means whereby at least half of the fluid discharged from said pumping cavity circulates at high pressure around said driven magnet, thereby positively and thoroughly flushing the interior of the pump.

* * * * *